US005501202A

United States Patent [19]

Watanabe

[11] Patent Number: 5,501,202

[45] Date of Patent: Mar. 26, 1996

[54] ENGINE COMPONENT LAYOUT FOR OUTBOARD MOTOR

[75] Inventor: Takahide Watanabe, Hamamatsu, Japan

[73] Assignee: Sanshin Industries Co., Ltd., Hamamatsu, Japan

[21] Appl. No.: 301,122

[22] Filed: Sep. 6, 1994

[30] Foreign Application Priority Data

Jun. 9, 1993 [JP] Japan ..... 5-221275
Jun. 9, 1993 [JP] Japan ..... 5-221276

[51] Int. Cl.[6] ..... F02B 25/06

[52] U.S. Cl. ..... 123/572; 123/195 P; 123/509; 440/88

[58] Field of Search ..... 123/41.86, 572, 123/573, 195 P, 509; 440/88, 89

[56] References Cited

U.S. PATENT DOCUMENTS 4,569,323 2/1986 Okumura ..... 123/41.86
4,597,372 7/1986 Furukawa ..... 123/572
4,667,647 5/1987 Ohtaka et al. ..... 123/573
5,036,822 8/1991 Kojima ..... 123/509

FOREIGN PATENT DOCUMENTS 3-32998 2/1991 Japan .
3-119562 12/1991 Japan .

*Primary Examiner*—Noah P. Kamen
*Attorney, Agent, or Firm*—Knobbe, Martens, Olson & Bear

[57] ABSTRACT

An engine of an outboard motor includes an improved engine component layout to minimize the size of the engine and to improve the performance of the components. A separator of a crankcase ventilation system is located on a cam cover outside the cam chamber in order to reduce the size of the cam cover while providing the necessary spacing between the separator and the valve mechanism within the cam chamber. A fuel pump is positioned at about the center of the cam cover, beneath the separator, to generally balance the length of fuel travel to each of the carburetors. A fuel filter also is located on the cam cover, beneath the fuel filter, to generally isolate the fuel filter from the effects of the heated cylinder head and block. The arrangement of these components does not interfere with the hinge-like travel of a top cowling, which surrounds the engine, relative to a lower tray.

20 Claims, 7 Drawing Sheets

ENGINE COMPONENT LAYOUT FOR OUTBOARD MOTOR

BACKGROUND OF THE INVENTION

1. Field of the Invention

The present invention relates in general to a marine engine, and more particularly to the layout of engine components of an outboard motor engine.

2. Description of Related Art

To improve the performance of a watercraft, the associated weight of and drag on the watercraft must be reduced. In regard to a watercraft's outboard motor, this means reducing the motor's weight and streamlining those portions of the motor which extend above or below the transom of the watercraft (i.e., the power head and the lower unit of the motor).

In connection with the motor power head, prior engine designs generally have not minimized the girth of the engine, and, thus, the size and weight of the protective cowling which surrounds the engine have not been minimized. Because the power head of a conventional outboard motor commonly extends well above the transom of the watercraft, a larger sized cowling produces more drag on the watercraft. A heavier cowling, of course, contributes to a greater overall weight of the watercraft which the motor must propel through the water. Both of these effects affect the performance of the watercraft.

In addition, an increased size and weight of the cowling makes it more difficult to remove the cowling, which is typically lifted over the engine. Increased size makes the cowling more cumbersome, and increased weight requires more strength to lift the cowling.

Although the desire to minimize the weight and size of the protective cowling is known, several engine components require specific spacing from one another. Conventional engine designs thus have increased the overall girth of the engine in order to accommodate such spacing requirements, and thus have increased the size and weight of the cowling.

For instance, the design of conventional cam covers accommodate the necessary spacing requirement between the cylinder head and a lubricant/ventilation gas separator, which is commonly located within a cam chamber of the cylinder head. In addition, conventional cam covers include an oil fill neck on the side of the cam cover. Japanese Patent Publication No. 3-32998 discloses an example of a conventional cam cover design. With the separator located on an inner side of the cam cover within the cam chamber, and with the oil fill neck located on the side of the cam cover, the height or profile of the cam cover (i.e., the extent to which the cam cover extends beyond the cylinder head) necessarily becomes greater. The overall girth of the engine thus increases.

Another example of prior engine designs increasing engine girth to accommodate spacing requirement between engine components involves the fuel supply system. The fuel pump and fuel filter of the fuel supply system conventionally are arranged on the intake side of the engine. The fuel filter is positioned in a lower tray of the cowling beneath the carburetors and the fuel pump is located on the side of cylinder head. Japanese Patent Publication No. 3-119562 discloses an example of this fuel supply system arrangement. Other conventional layouts position the fuel filter on the side of the cylinder head and the fuel pump on the cam cover.

These designs, however, require a larger cowling in order to distance the fuel filter from the cylinder head and block. The placement of the fuel filter adjacent the highly heated cylinder head commonly heats the filter to a sufficient temperature to vaporize the fuel within the filter. This creates a vapor lock and the engine stalls. To resolve this problem, conventional engine designs have increased the size of the cowling to distance the fuel filter from the cylinder head.

The conventional placement of the fuel filter in the lower tray beneath the carburetors also frustrates access to the filter. The filter typically can not be cleaned or changed without removing the entire filter housing. The position of the housing in the tight space between the lower tray and carburetors also makes removal difficult. To improve access to and to ease removal of the fuel filter, some prior designs have increased the size of the cowling; however, this results in the above-noted disadvantages of increased weight and drag.

In prior engine designs, the fuel pump commonly is located at the bottom of the cylinder head or cam cover in order for all fuel delivery conduits to extend vertically upward to the carburetors. Japanese Patent Publication No. 3-119562 discloses an example of this conventional fuel pump location. This arrangement, however, results in a substantial imbalance in the fuel travel distances between the carburetors, and complicates the even distribution of fuel between the carburetors.

SUMMARY OF THE INVENTION

As indicated by the above discussion of prior engine designs, the layout of the engine must account for the necessary spacing and location requirements of the engine components, while minimizing the overall size and weight of the engine and cowling. Prior engine designs, however, have not sufficiently achieve these goals.

The above-noted drawbacks associated with prior fuel supply systems are exacerbated where the engine fuel requirement increases. The size of fuel pump and fuel filter necessarily must increase to accommodate the increased fuel demand. The enlarged size of these engine components therefore demands careful consideration of the layout of these components.

In addition to the above-noted spacing requirements between engine components, the cowling design also requires specific clearances to ease removal of the cowling to expose the motor. One side of the cowling typically is pivoted upward over at least a portion of the engine to remove the cowling. As such, sufficient space must exist between the cowling and the engine in order for the bottom edge of the cowling to clear the engine as the cowling is pivoted. This clearance requirement further complicates the engine layout design.

A need therefore exists for an outboard motor having an engine arrangement which reduces the effect of the heat generated by the engine on the fueling system, balances the extent of fuel travel between the fuel pump and the carburetors, and reduces the overall size and weight of the engine and protective cowling while accommodating for larger sized fuel supply components and for the necessary spacing between the engine and cowling.

In accordance with one aspect of the present invention, an engine for an outboard motor has a cylinder block interposed between a cylinder head and a crankcase. The engine additionally includes a cam cover attached to the cylinder head to enclose a cam chamber within the cylinder head. A valve operating mechanism is positioned within the cam chamber. A lubricant/vapor separator is located on the cam cover outside of the cam chamber, so as to reduce the size of the cam cover.

In accordance with another aspect of the present invention, an engine for an outboard motor has a cylinder block interposed between a cylinder head and a crankcase. The engine additionally includes a cam cover attached to the cylinder head. The cam cover and cylinder head together define a cam chamber. A fuel supply system includes a fuel pump which communicates with a fuel filter. The fuel pump and fuel filter are attached to the cam cover on a peripheral surface outside of the cam chamber.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
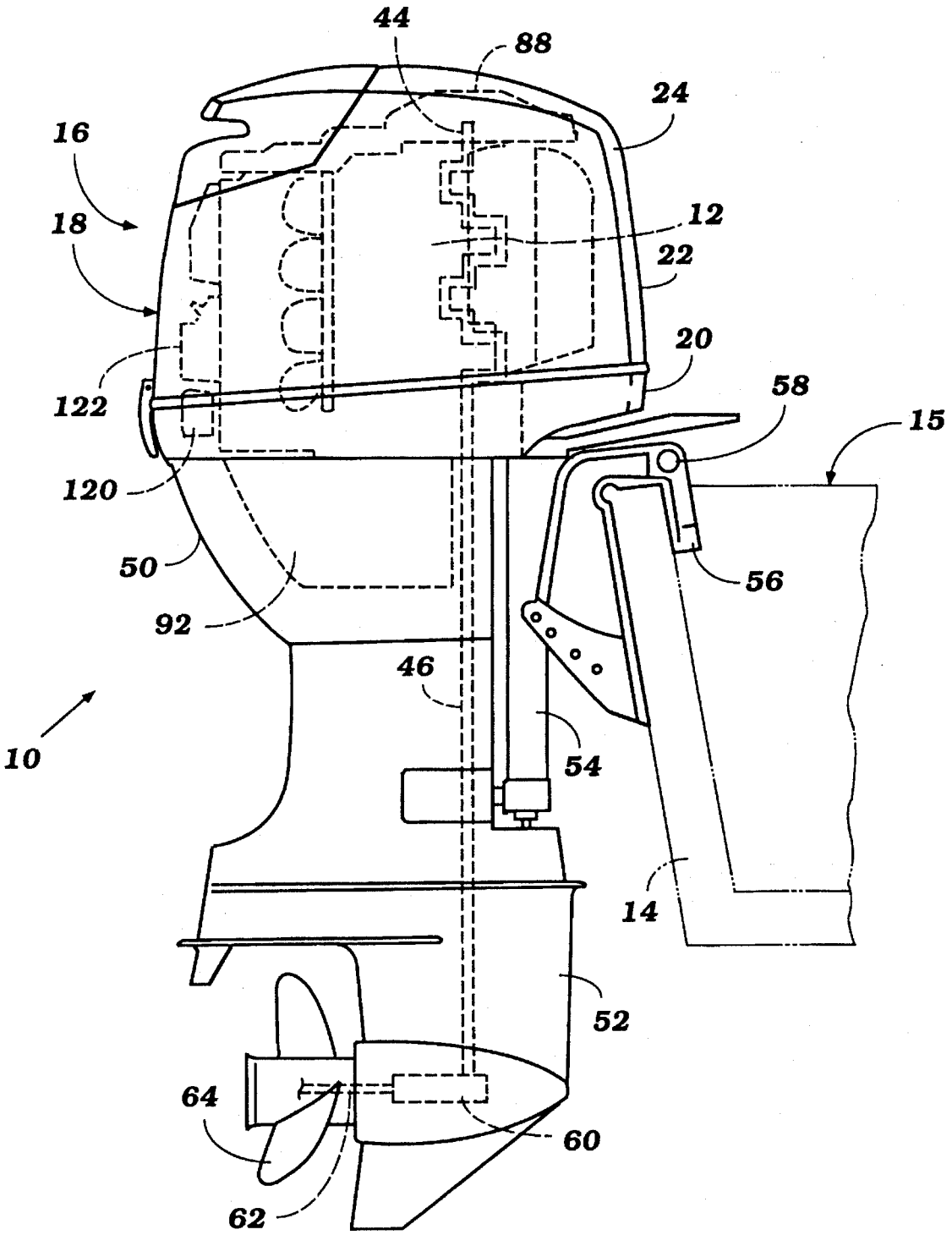
FIG. 1 is a side elevation view of an outboard motor constructed in accordance with a preferred embodiment of the present invention and attached to a transom of an associated watercraft, shown partially in phantom.

FIG. 1 illustrates a marine outboard drive 10 which incorporates an internal combustion engine 12 configured in accordance with a preferred embodiment of the present invention. In the illustrated embodiment, the outboard drive 10 is depicted as an outboard motor for mounting on a transom 14 at the stern of a watercraft 15. It is contemplated, however, that certain aspects of the present invention can be employed with an inboard/outboard motor as well.

In the embodiment illustrated in FIG. 1, the outboard drive 10 has a power head 16 which includes the present engine 12. The engine 12 in the illustrated embodiment is a four-stroke, in-line, four-cylinder combustion engine. It will be readily apparent to those skilled in the art, however, that the invention may be employed with engines having other numbers of cylinders, having other cylinder orientations, and/or operating on other than a four-stroke principle.

A protective cowling assembly 18 surrounds the engine 12. The cowling assembly 18 desirably includes a lower tray portion 20 and a top cowling member 22. These elements 20, 22 of the protective cowling assembly 18 together define an engine compartment 24 which houses the engine 12. A standard gasket 25 seals the junction between the lower tray 20 and the cowling 22 to prevent water flow into the engine compartment 24.

Figure 2:
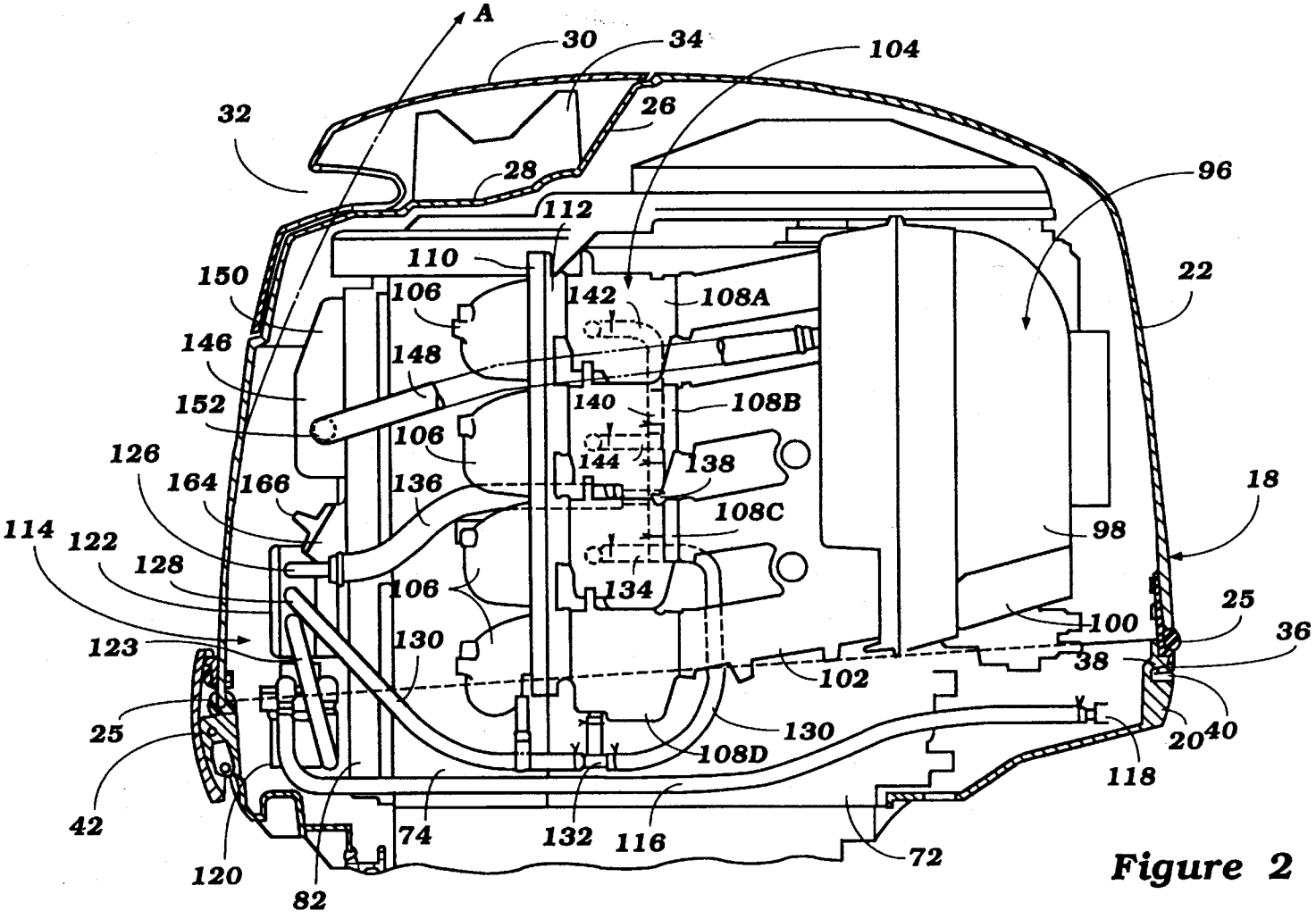
FIG. 2 is an enlarged, cut-away side elevational view of a power head of the marine outboard motor of FIG. 1.

With reference to FIG. 2, the top cowling 22 includes a relief 26 which includes at least one aperture 28. The aperture 28 opens into the engine compartment 24 of the cowling assembly 18. A handle insert 30 is affixed to the top cowling within the recess 26 and over the aperture 28. The handle insert 30 includes an inlet opening 32 to allow ambient air to flow inside the handle insert 30, through the aperture 28, and into the engine compartment 24. The handle insert 30 also includes a baffle 34 disposed between the inlet opening 32 and the cowling aperture 28 to inhibit water flow into the engine compartment 24. As known in the art, the inlet opening 32 acts as a drain for the water removed from the influent airflow by the baffle 34, and functions as a handle for raising and lowering the outboard drive 10.

On the front side of the top cowling 22, opposite the handle insert 30, the top cowling 22 includes a hook 36 which captures a corresponding portion of the lower tray 20. Specifically, the hook 36 has a U-shaped portion which fits around a generally squared lug 38 formed at an upper end of the lower tray 20. The lower tray also includes a recess beneath the lug 38 which receives a portion of the hook 36. The recess 40 has a sufficient size so as to allow the hook 36 to rotate about the lug 38, as well as to allow the hook 36 to be slid off the lug 38 to disengage the upper cowling 22 from the lower tray 20.

The cowling assembly 18 additionally includes a standard latch 42 that locks the top cowling 22 to the lower tray 20. With the latch 42 unlocked, the top cowling 22 can be pivoted in the direction of arrow A with the hook 36 rotating about the lug 38 so as to expose at least a portion of the engine 12. In addition, with the latch 42 unlocked and the top cowling 22 partially rotated in direction A, the top cowling 22 can be slid out of engagement with the lower tray 20 and completely removed so as to expose the portion of the engine 12 which extends above the lower tray 20.

Figure 3:
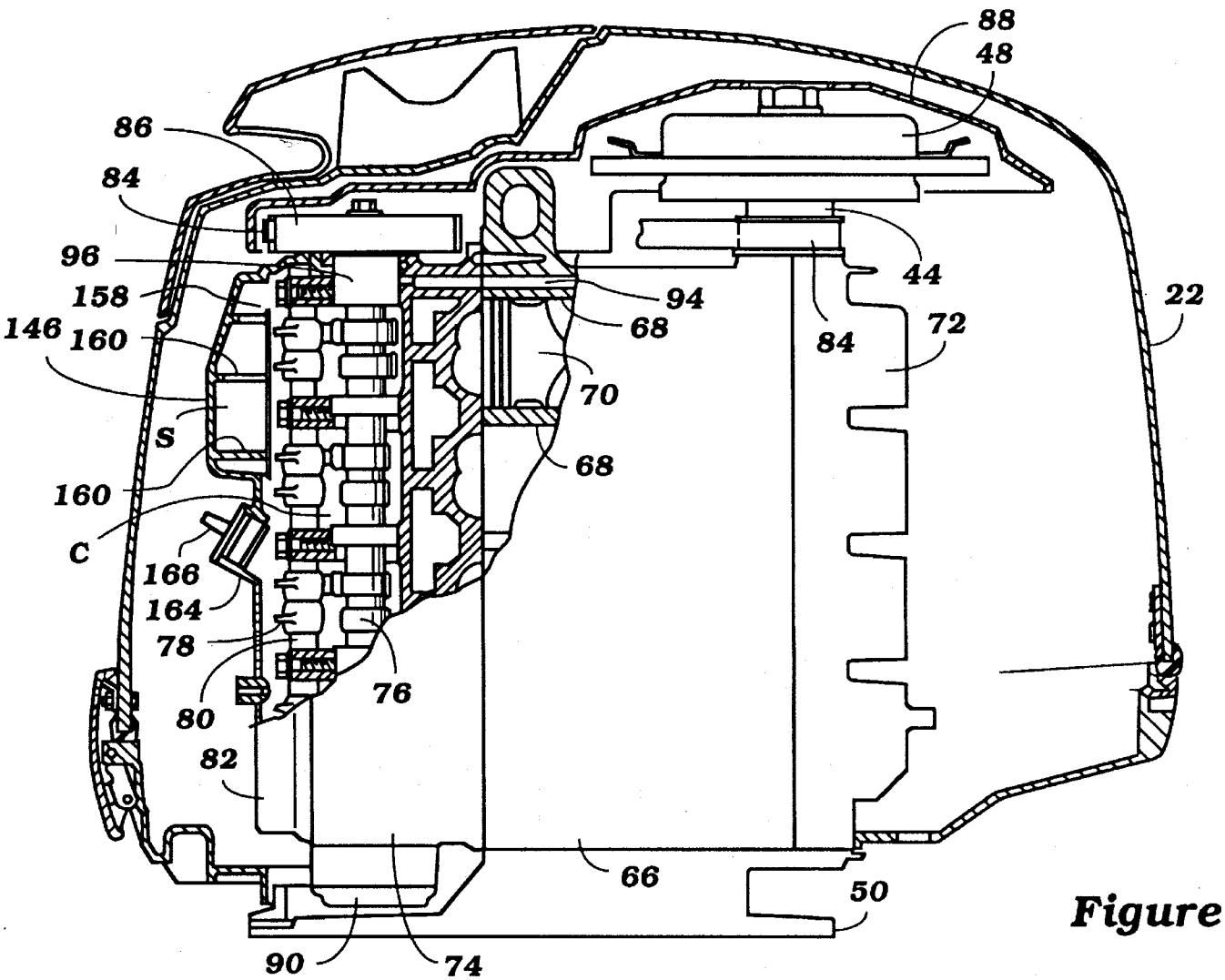
FIG. 3 is a partially cut-away side elevational view of the power head of FIG. 2, illustrating a cylinder block and cylinder head assembly thereof.

With reference to FIG. 1, the engine is conventionally mounted with its output shaft 44 (i.e., crankshaft), which is schematically illustrated in phantom, rotating about a generally vertical axis. The crankshaft 44 drives a drive shaft 46, which depends downward from the power head 16 of the outboard drive 10. As best seen in FIG. 3, a standard magneto generator/flywheel assembly 48 is attached to the upper end of the crank shaft 44.

As seen in FIG. 1, an drive shaft housing 50 extends from the lower tray 20 and terminates in a lower unit 52. A steering bracket 54 is attached to the drive shaft housing 50 in a known manner. The steering bracket 54 also is pivotally connected to a clamping bracket 56 by a pin 58. The clamping bracket 56, in turn, is configured to attached to the transom 14 of the watercraft 15. This conventional coupling permits the outboard drive 10 to be pivoted relative to the steering bracket 54 for steering purposes, as well as to be pivoted relative to the pin 58 to permit adjustment to the trim position of the outboard drive 10 and for tilt up of the outboard drive 10.

Although not illustrated, it is understood that a conventional hydraulic tilt and trim cylinder assembly, as well as a conventional hydraulic steering cylinder assembly could be used as well with the present outboard drive. It is also understood that the above description of the construction of the outboard drive is conventional, and, thus, further details of the steering, trim, and mounting assemblies are not necessary for an understanding of the present invention.

As schematically illustrated in FIG. 1, the drive shaft 46 extends through and is journaled within the drive shaft housing 50. A transmission 60 selectively couples the drive shaft 46 to a propulsion shaft 62. The transmission 60 desirably is a forward-, neutral-, reverse-type transmission.

The propulsion shaft 62 drives a propulsion device 64, such as, for example, a propeller or hydrodynamic jet. In the illustrated embodiment, the propulsion device 58 is a single propeller; however, it is understood that a counter-rotational propelling device can be used as well.

As best seen in FIG. 3, the engine 12 includes a cylinder block 66 which in the illustrated embodiment defines four in line cylinder bores 68 (two of which are illustrated). Pistons 70 reciprocate within the cylinder bores 68, and connecting rods (not shown) link the pistons 70 and the crankshaft 44 together so that the reciprocal linear movement of the pistons 70 within the cylinder bore 68 rotates the crankshaft 44 in a known manner. A crankcase 72 is attached to the cylinder block 66 and surrounds at least a portion of the crankshaft 44. The crankshaft 44 is journaled within the a crankcase chamber, which is formed by the crankcase 72 and the cylinder block 66, so as to rotate about a generally vertical axis.

On the opposite end of the cylinder block 66, a cylinder head 74 is attached to close an end of the cylinder bores 68. The cylinder head 74 generally has a conventional construction and supports a plurality of intake and exhaust valves (not shown). The cylinder head 74 also journals and houses at least one camshaft 76 which operates the valves.

In the illustrated embodiment, the overhead camshaft 76 actuates rocker arms 78 journaled about a rocker shaft 80 to operate the valves within the cylinder head 74. It is understood, however, that a plurality of overhead camshafts (e.g., intake and exhaust camshafts) can operate the valves directly using tappets, or can be located to the sides of the cylinders and operate the valves via push rods, as known in the art. Because the present invention deals primarily with the arrangement of engine components, it is believed unnecessary to provide further description of the particular valve mechanism beyond that provided above.

A cam cover 82 together with the cylinder head 74 define a cam chamber C in which the valves, camshaft 76, and rocker arm shafts 80 are located. The cam cover 82 is attached to the cylinder head 74 on a side opposite that of the cylinder block 66.

An external toothed timing belt 84 extends between the crankshaft 44 and a pulley 86 coupled to the camshaft 76. As known in the art, the pulley 86 has a diameter twice that of a pulley on the crankshaft 44 so that the crankshaft 44 drives the camshaft 76 at half the rotational speed of the crankshaft 44. An upper cover 88 covers the external belt 84 and pulley 86, as well as the magneto generator/flywheel assembly 44.

The engine 12 also includes a conventional lubrication system which circulates lubricant through the engine 12. A lubricant pump 90 delivers lubricant from a lubricant pan 92 (see FIG. 1), which is housed in the drive shaft housing 50, through a lower gallery (not shown) to the crankcase 72. A series of conventional conduits within the crankcase 72 deliver the lubricant to the bearings which journal the crankshaft 44 within the crankcase 72 and cylinder block 66. An upper gallery 94 delivers the lubricant from the crankcase 72 to a bearing 96 of the camshaft 76. Once at the top of the cylinder head 74, the lubricant drains through the cam chamber C, over the camshaft 76, rocker arm shaft 80, and valve stems (not shown) to lubricate the corresponding bearing surfaces. The lubricant drains from the cam chamber C to the lubricant pan 92 (see FIG. 1).

With reference to FIG. 2, the engine 12 also includes an induction system 96. The induction system 96 includes an intake silencer 98 having a downwardly facing air inlet 100 which is disposed to the front of the power head 16 and on one side of the crankcase 72. The intake silencer 98 draws air into the engine from the interior of the cowling 18 and silences the intake air charge.

A series of induction pipes 102 deliver air from the intake silencer 98 to a plurality of charge formers 104. The lengths of the induction pipes 102 desirably are tuned with the intake silencer 98 to minimize the noise produced by the induction system, as known in the art.

The charge formers 104 produce a charge of air and fuel which is delivered to a plurality of intake pipes 106 of the cylinder head 74. Each individual intake pipe 106 communicates with an individual combustion chambers of the engine 12 through the intake valve system (not shown). As seen in FIG. 2, the charge former 104 is interposed between the induction pipes 102 and the intake pipes 106 of the cylinder head 74.

In the illustrated embodiment, the charge formers 104 are a plurality of vertically aligned carburetors 108, each connected to an intake pipe 106. It should be understood, however, that although the invention is described in conjunction with a carbureted engine, certain facets of the invention may be employed in conjunction with other types of charge formers, such as fuel injectors or the like. For ease of description, each carburetor will be designated by an A, B, C, or D suffix, identified from the top down, and the collection of carburetors shall be designated generally by reference numeral 108, without suffix.

The carburetors 108 may be of any known type and construction; however, each carburetor is provided with a fuel bowl (not shown) to which fuel is admitted through a float controlled valve (not shown) so as to maintain a uniform head of fuel therein. As well known in the carburetor art, these fuel bowls are vented to the intake passage (not shown) of the carburetor so as to maintain a uniform pressure balance.

The carburetors 108 are attached between the induction pipes 102 and the intake pipes 106. Each carburetor 108 serves a respective cylinder 68 (FIG. 3), and thus is aligned with the corresponding intake pipe 106. Specifically, the intake pipes 106, which are integrally formed into an intake manifold of the cylinder head 74, terminate in a flange portion 110 that extends generally parallel to and in the same plane as a sealing surface of the cylinder head 74, which engages the cylinder block 66. The carburetors 108 are attached to the corresponding intake pipes 106 by means that include a common mount plate 112. The common mount plate is attached to the flange portion of the intake manifold in a known manner. On the opposite side of the carburetors (i.e., the inlet side), the carburetors 108 are attached to the outlet end of the induction pipes 102 in a known manner.

A fuel supply system 114 delivers fuel to the charge former 104. In the illustrated embodiment, the fuel supply system 114 includes a main fuel conduit 116 that extends from a quick disconnect coupling 118 positioned at the front side of the lower tray (i.e., the end proximate to the crankcase 72) to a fuel filter 120. The quick disconnect coupling 118 provides for a detachable connection to a remote fuel source (not shown), as known in the art. The main fuel conduit 116 delivers fuel from the fuel source to the fuel filter 120 positioned at the rear of the power head 16, proximate to the cylinder head 74.

Figure 4:
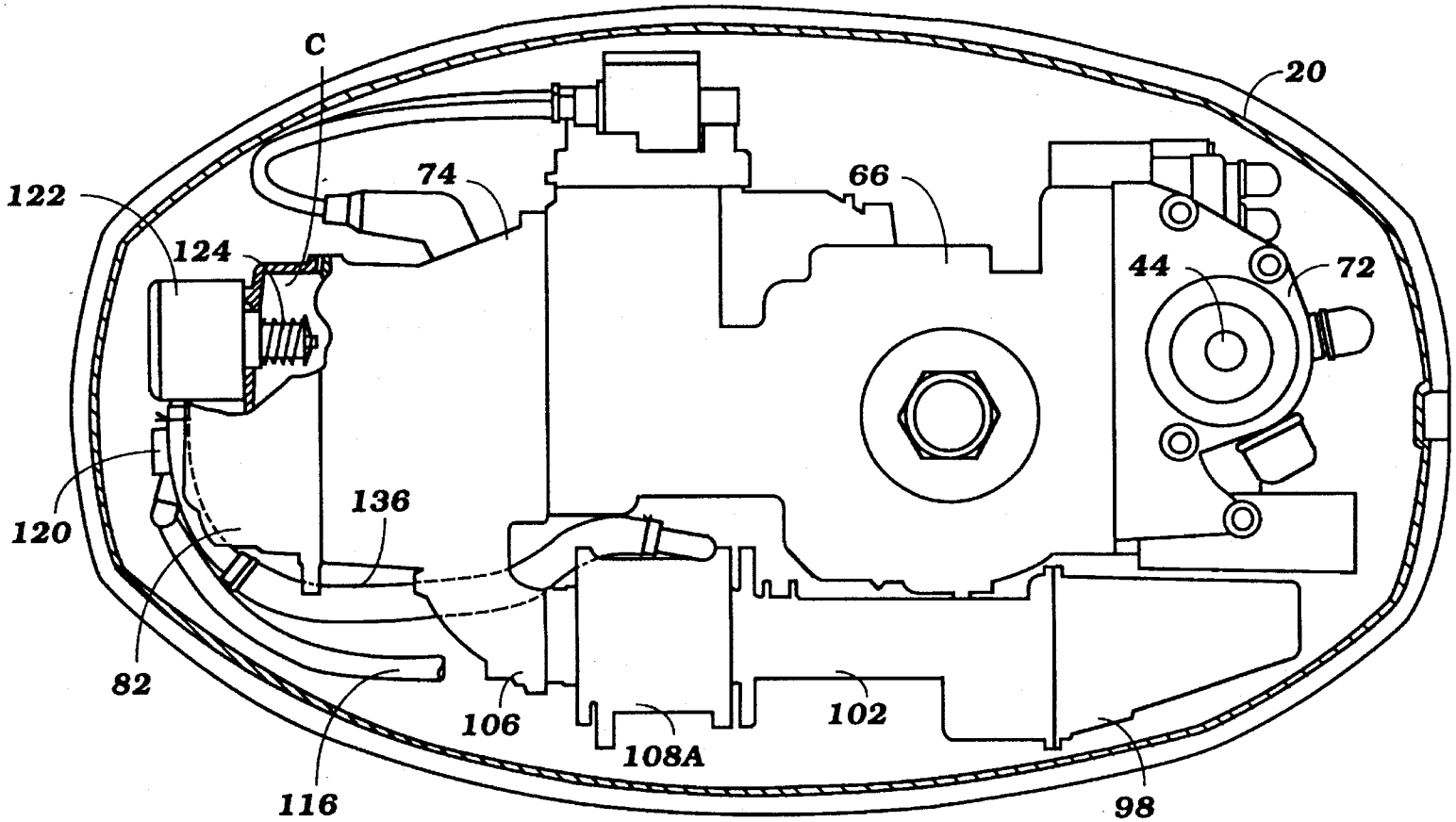
FIG. 4 is a top plan view of the power head of FIG. 2 with a top cowling of the power head removed to exposed an engine.

A fuel pump 122 communicates with the fuel filter 120 so as to draw fuel through the main fuel conduit 116 and through fuel filter 120. A conduit 123 connects the fuel pump 122 to the fuel filter and delivers filtered fuel to the fuel pump 122. The fuel pump 122 is operated by the camshaft 76 of the engine actuated by one of the rocker arms 78. For this purpose, as seen in FIG. 4, the fuel pump 122 has an actuating plunger 124 extending into the cam chamber C through the cam cover 82.

With reference to FIG. 2, the fuel pump 122 includes an upper discharge port 126 and a lower discharge port 128. Each discharge port 126, 128 is positioned vertically above the fourth (i.e., lowermost) carburetor 108D, and specifically above its fuel bowl, and below the first (i.e., uppermost) carburetor 108A and its fuel bowl. In the illustrated embodiment, the lower fuel discharge 128 is disposed above the fourth carburetor 108D and below the third (i.e., next lowest) carburetor 108C. The upper fuel discharge 126 is disposed at approximately the level of the third carburetor 108C and below the two upper carburetors 108A, 108B. Because of this positioning, the length which the fuel must travel vertically from the fuel pump 122 to the respective carburetors 108 is shorter.

A first fuel delivery conduit 130 extends from the lower fuel discharge port 128 downward and has a first branch 132 that extends vertically upward and delivers fuel to the fuel bowl of the fourth carburetor 108D. The first conduit 130 extends upward from the first branch 132 and has a horizontally extending branch 134 that extends to the fuel bowl of the third carburetor 108C.

A second fuel delivery conduit 136 extends upward from the upper fuel discharge port 126 and feeds a T-connection 138 to a vertically extending conduit 140. The vertically extending conduit 140 intersects with the horizontal branch 134 of the first conduit 130, and hence, the first and second conduits 130, 136 communicate with each other. In addition, the vertically extending conduit 140 has branches 142, 144 that extend to the fuel bowls of the first and second carburetors 108A, 108B, respectively.

An intermediate portion of the second conduit 136 passes through an aperture in the mounting flange 110 to ensure that the conduit 136 extends upward so that any air or fuel vapor in the system can rise toward the fuel bowl of the first carburetor 108A, thereby acting as a fuel vapor separator to purge vapor and air from the system. As a result, even though the first conduit 130 has a downwardly extending section, air or vapor cannot be trapped in the conduitry.

As seen in FIG. 2, the cam cover 82 is formed with a lubricant/vapor separator 146 which separates lubricant from the crankcase ventilation gases. As known in the art, combustion gases which pass through the piston rings into the crankcase (i.e., "blow-by gases") are used to ventilate the lubricant in the crankcase. The lubricant flow within the lubrication system entrains these gases which are transported from the crankcase to the cylinder head. The separator 146 is connected to the induction system 96 via a conduit 148 so that the ventilation gases flow through the crankcase 72 and cylinder head 74, and exit the cylinder head 74 through the separator 146. The blow-by gas then flows through the conduit 148 to the air intake silencer 98 for recirculation through the engine 12 to reduce undesirable exhaust emissions.

Figure 5:
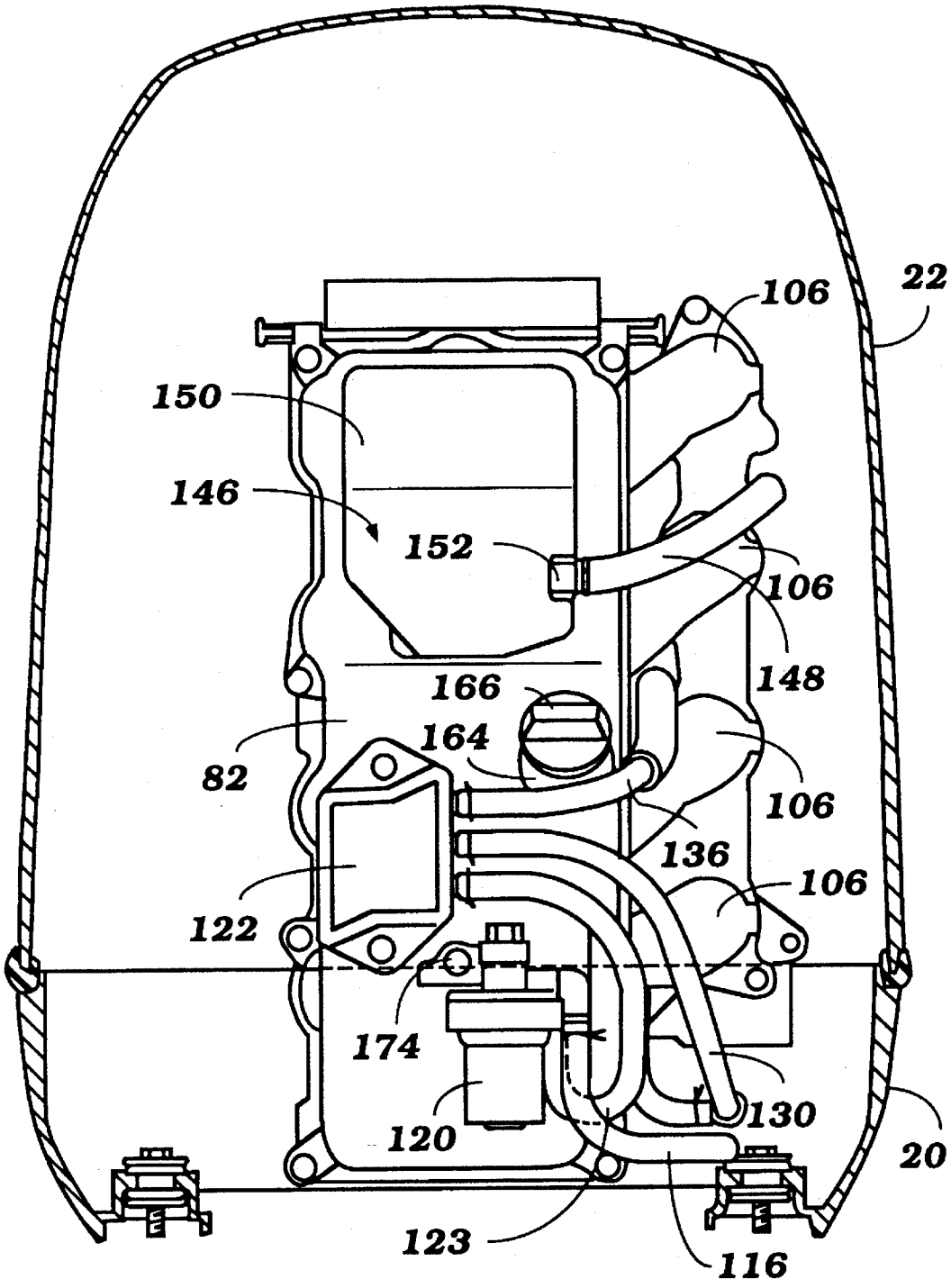
FIG. 5 is an enlarged, cut-away rear elevational view of the power head of FIG. 2.

As best seen in FIGS. 2 and 5, the separator 146 is formed at an upper end of the cam cover 82. The separator includes a chamber case 150 formed integrally with the cover 82 which defines a vapor collection chamber S external of the cam chamber within the cylinder head 74. An upper edge of the chamber case 150 is sloped so as to reduce the profile of the separator at its upper end to provide clearance for the top cowling 22 as it swings along line A (FIG. 2). An effluent port 152 of the separator communicates with the vapor chamber S. The effluent port 152 desirably is configured as a hose bib to receive an end of the conduit 148. The conduit 148 in turn connects the effluent port 152 to the intake silencer 98.

Figure 6:
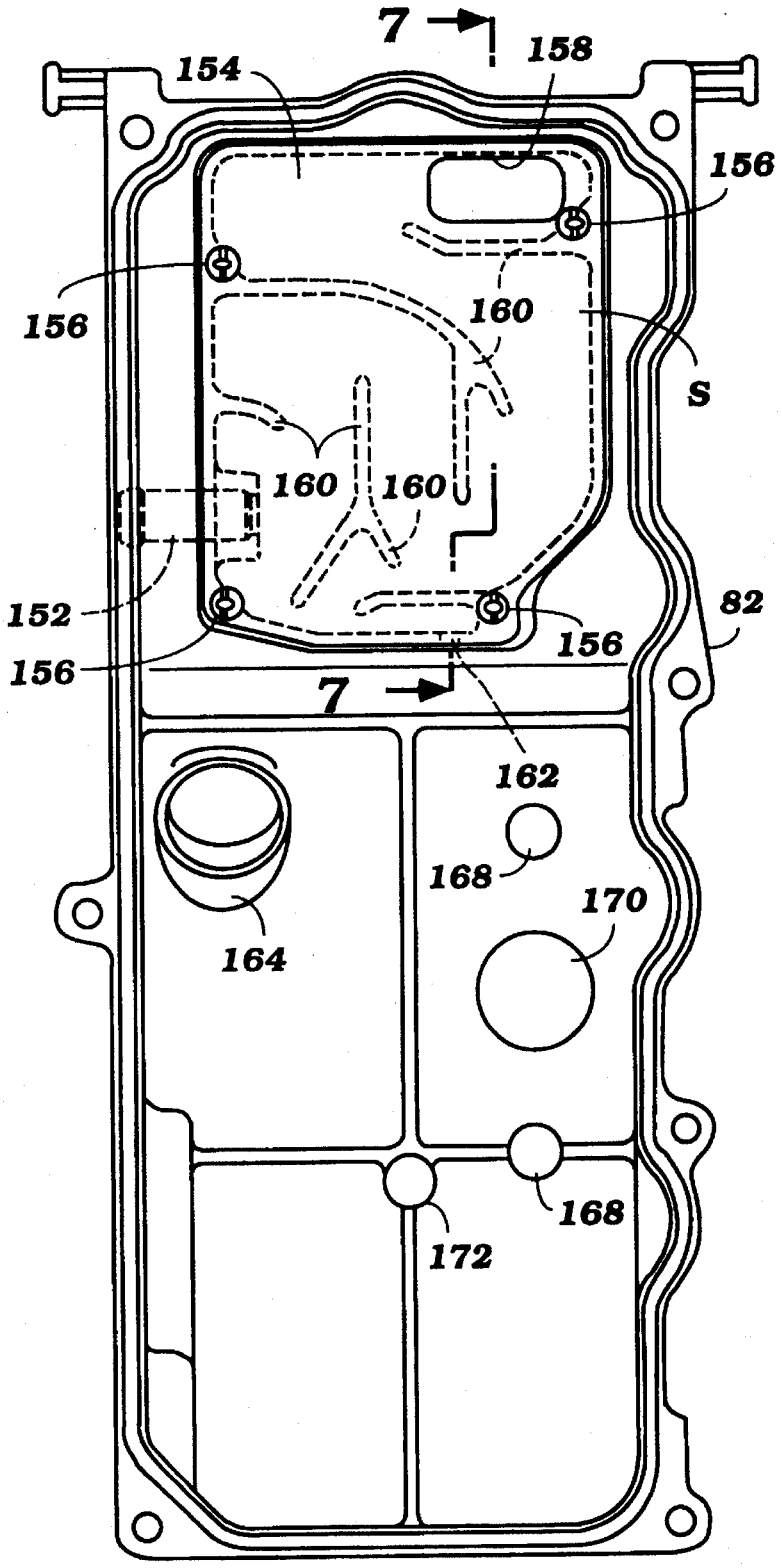
FIG. 6 is a plan view of an inner surface of a cam cover of the engine of FIG. 4.
Figure 7:
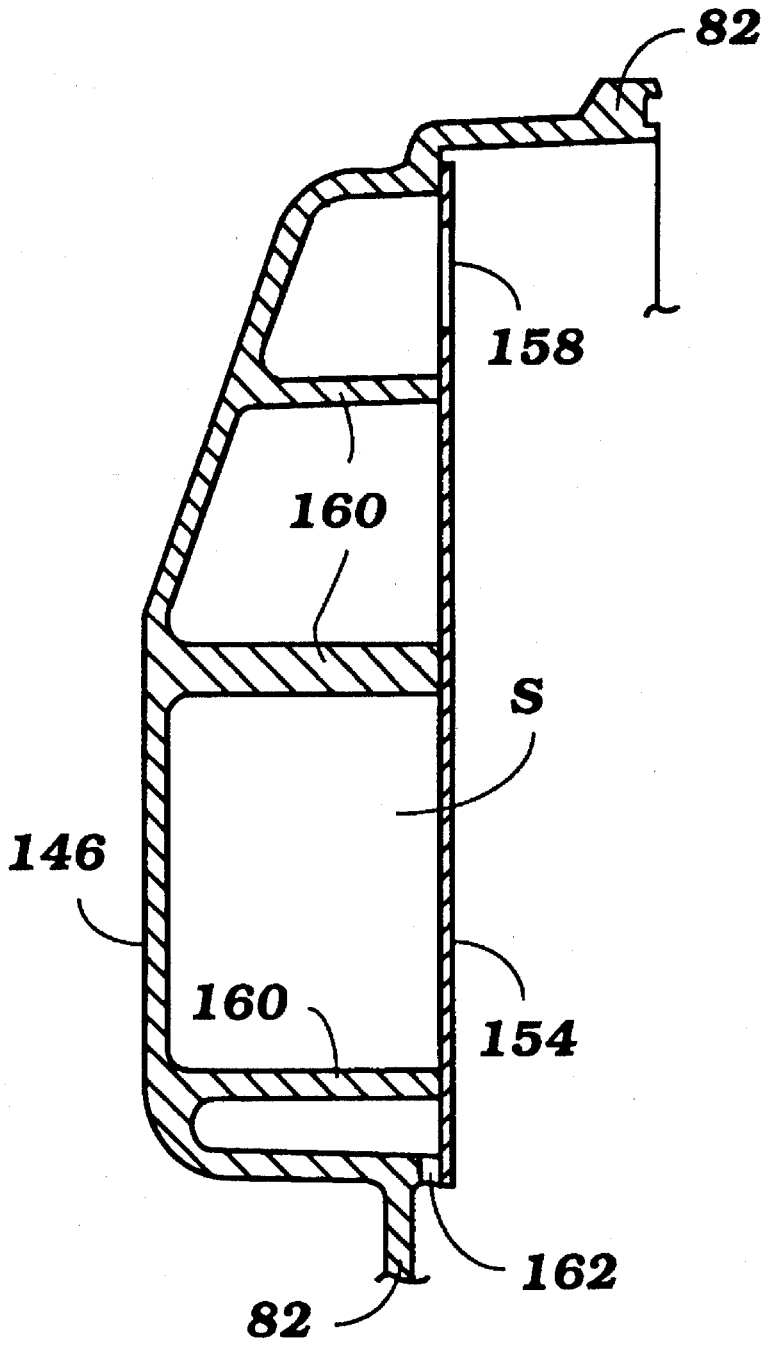
FIG. 7 is a partial cross-sectional view of a lubricant/vapor separator on the outside of the cam cover of FIG. 6, taken along line 7—7.

As illustrated in FIG. 6, a plate 154 completes the vapor chamber S and separates it from the cam chamber C. Screws 156 attach the plate to an inner surface of the cam cover 82. The plate 154 includes an opening 158 which places the vapor chamber S in communication with the cam chamber C within the cylinder head 74. As seen in FIGS. 6 and 7, the separator 148 also includes a baffle 160 which has a labyrinth structure configured to separate lubricant from the crankcase ventilation gases, as known in the art. The separator 146 also includes a lower opening 162 through which lubricant, separated from the ventilation gases by the baffle 160, drains from the vapor chamber S into the cam chamber C. As best seen in FIG. 6, the lower opening 164 is positioned below the effluent port 152 so that the separated lubricant will not flow through the effluent port 152.

With reference to FIGS. 2, 5, and 6, the cam cover is provided with a fill neck 164 that has a removable cap 166 so that lubricant may be added to the lubrication system of the engine through the fill neck 164. As best seen in FIGS. 5 and 6, the fill neck 164 is desirably positioned off-center on the cam cover 82 at a position below the chamber case 150 of the separator 146. This position allows access to the fill neck 164 with minimal interference by the chamber case 150.

As seen in FIGS. 2 and 5, the fuel pump 122 also is positioned off-center on the cam cover 82 on a side opposite of and below the fill neck 164. As best seen in FIG. 6, the cam cover 82 includes threaded bosses 168, which receive a pair of bolts that secure the fuel pump 122 to the cam cover 82. The cam cover 82 also includes an aperture 170 through which the actuator plunger 124 (FIG. 4) of the fuel pump 122 extends into the cam chamber C.

FIGS. 2 and 5 illustrate the generally central position of the fuel pump 122 on the cam cover 82, as viewed in the vertical direction, and relative to the carburetors 108. This position of the fuel pump 122, proximate to the middle carburetors 108B, 108C, provides for more equal lengths of fuel travel between the fuel pump 122 and each carburetor 108 than that provided by prior fuel supply systems. Fuel delivery thus is better balanced between each carburetor 108.

FIGS. 2 and 5 also illustrate the position of the fuel filter 120 on the cam cover 82. The fuel filter 120 is positioned off-center towards the fill neck 164 and below the fuel pump 122. As seen in FIG. 6, the cam cover 82 includes a threaded boss 172 which receives a bolt 174 that secures the fuel filter 120 to the cam cover 82.

As best seen in FIG. 5, the staggered layout of the separator 146, the fill neck 164, the fuel pump 122, and the fuel filter 120 on the cam cover 82 provides for a compact arrangement of these engine components. In addition, by locating the separator 146 external of the cam chamber, the cam cover 82 can have a lower profile, and the space below the separator 146 can be filled with the fill neck 164, the fuel pump 122 and the fuel filter 120. In addition, the position of the fuel pump 122 and fuel filter 120 on the cam cover 82 distances these components from the cylinder block 66 and cylinder head 74, thereby reducing the effect of the resultant heat generated by engine operation on these components. This position also allows the components to be located on the engine rather than on the cowling, the size and the weight of the cowling, as well as providing a more accessible position for these components.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. An engine for an outboard drive having a cylinder block interposed between a cylinder head and a crankcase, said engine further comprising a cam cover attached to said cylinder head to enclose a cam chamber within said cylinder head containing a valve operating mechanism, and a lubricant/vapor separator located on said cam cover outside of said cam chamber, said separator including an upper opening through which crankcase ventilation gases flow into said vapor chamber of said separator from said cam chamber, an intermediate opening through which the ventilation gases are vented for recirculation through the engine, and a lower opening through which lubricant, separated from the ventilation gases by said baffle, flows from said vapor chamber into said cam chamber.

2. The engine of claim 1, wherein said separator is formed by a chamber case integrally formed with said cam cover and a plate attached to an inner surface of said cam cover which separates said cam chamber from a vapor chamber of said separator.

3. The engine of claim 2, wherein said separator includes a baffle positioned within said vapor chamber, said baffle having a labyrinth structure to separate lubricant from ventilation gases.

4. The engine of claim 1 additionally comprising a fuel supply system including a fuel pump attached to said cam cover on a peripheral surface outside said cam chamber.

5. The engine of claim 4 wherein said peripheral surface of said cam cover lies generally vertically and said separator is located on said peripheral surface of said cam cover above from said fuel pump.

6. The engine of claim 5, wherein said fuel supply system additionally comprises a fuel filter which communicates with said fuel pump, said fuel filter being attached to said peripheral surface of said cam cover below said fuel pump.

7. The engine of claim 6, wherein said separator, fuel pump and fuel filter are arranged on said cam cover so as to minimize the extent to which said separator, fuel pump and fuel filter protrude from said peripheral surface of said cam cover in a direction away from said cylinder head.

8. The outboard drive of claim 7, wherein said cam cover includes a lubricant fill neck located between said separator and said fuel filter.

9. An outboard drive for a watercraft comprising engine having a cylinder block interposed between a cylinder head and a crankcase, said cylinder head defining a plurality of aligned intake pipes, said engine further comprising a cam cover attached to said cylinder head and defining with said cylinder head a cam chamber, and a fuel supply system comprising a fuel pump communicating with a fuel filter, said fuel pump and said fuel filter being attached to a cam cover on a peripheral surface outside said cam chamber.

10. The outboard drive of claim 9 additionally comprising a lubricant/vapor separator located on said peripheral surface of cam cover.

11. The outboard drive of claim 10, wherein said peripheral surface of said cam cover lies generally vertically and said separator is located on said cam cover above from said fuel pump, and said fuel pump is located on said cam cover above said fuel filter.

12. The outboard drive of claim 11, wherein said cam cover includes a lubricant fill neck located between said separator and said fuel filter.

13. The outboard drive of claim 10, wherein said separator, fuel pump and fuel filter are arranged on said cam cover so as to minimize the extent to which said separator, fuel pump and fuel filter protrude from said peripheral surface of said cam cover in a direction away from said cylinder head.

14. The outboard drive of claim 9, wherein said fuel pump is located on said cam cover at a position proximate to the center of said plurality of intake pipes of said cylinder head which are aligned in a direction generally parallel to the peripheral surface of said cam cover.

15. The outboard drive of claim 9 additionally comprising a cowling assembly including a lower tray and a top cowling which cooperate to enclose said engine, said lower tray being attached to a drive shaft housing which supports a drive shaft coupled to said engine, said lower tray and said top cowling being coupled together such that said top cowling at least partially pivots from a closed position in which said engine is enclosed within said cowling assembly to an open position in which at least a portion of said engine is exposed.

16. The outboard drive of claim 15, wherein said lower tray and said top cowling are interconnected on a side of the cowling assembly proximate to said crankcase of said engine.

17. The outboard motor of claim 15, wherein said fuel pump and fuel filter are arranged so as not to interfere with the movement of the top cowling between said open and closed positions.

18. The outboard motor of claim 15, wherein said fuel pump and said fuel filter are positioned on said cam cover at a location proximate to said lower tray.

19. The outboard motor of claim 15, wherein said engine additionally comprises a lubricant/vapor separator located on said peripheral surface of said cam cover outside said cam chamber, above said fuel pump and said fuel filter, and arranged so as not to interfere with said movement of said top cowling between said open and closed positions.

20. The outboard motor of claim 19, wherein said separator, fuel pump and fuel filter are arranged on said cam cover so as to minimize the extent to which said separator, fuel pump, and fuel filter protrude from said peripheral surface of said cam cover in a direction away from said cylinder head.

* * * * *

UNITED STATES PATENT AND TRADEMARK OFFICE

CERTIFICATE OF CORRECTION

PATENT NO. : 5,501,202

DATED : March 26, 1996

INVENTOR(S) : Takahide Watanabe

It is certified that error appears in the above-indentified patent and that said Letters Patent is hereby corrected as shown below:

Column 9:
In Claim 1, at line 8: after "flow into", replace "said" with --a--.

Column 9:
In Claim 1, at line 13: before "baffle", replace "said" with --a--.

Column 9:
In Claim 2, at line 4: before "vapor chamber", replace "a" with --said--.

Column 9:
In Claim 3, at line 2: before "baffle", replace "a" with --said--.

Signed and Sealed this

Seventeenth Day of December, 1996

*Attest:*

*Attesting Officer*

BRUCE LEHMAN

*Commissioner of Patents and Trademarks*